US005667591A

United States Patent [19]

Mailänder

[11] Patent Number: 5,667,591

[45] Date of Patent: Sep. 16, 1997

[54] DEVICE FOR ADJUSTING PRESSURE APPLIED TO A VARNISHING CYLINDER OF A VARNISHING MACHINE

[75] Inventor: Udo Mailänder, Bietigheim-Bissingen, Germany

[73] Assignee: LTG Lufttechnische GmbH, Stuttgart, Germany

[21] Appl. No.: 629,242

[22] Filed: Apr. 8, 1996

[30] Foreign Application Priority Data

Apr. 7, 1995 [DE] Germany ..... 195 13 132.0
Apr. 29, 1995 [DE] Germany ..... 195 15 824.5

[51] Int. Cl.[6] ..... B05C 1/00

[52] U.S. Cl. ..... 118/712; 118/249; 118/256; 118/262; 118/264

[58] Field of Search ..... 118/663, 708, 118/712, 249, 262, 264, 256, 46; 101/416.1, 424.2, 247, 216

[56] References Cited

U.S. PATENT DOCUMENTS 4,610,216 9/1986 Paulsen ..... 118/46
4,704,296 11/1987 Leanna et al. ..... 118/249
4,815,413 3/1989 Kofa ..... 118/46
5,228,390 7/1993 Jahn ..... 101/247
5,272,975 12/1993 Dettinger et al. ..... 101/247

*Primary Examiner*—Laura Edwards
*Attorney, Agent, or Firm*—Anderson Kill & Olick P.C.

[57] ABSTRACT

A device for adjusting pressure between the varnishing and pressure cylinders and between the varnishing cylinder and the varnish feed roller of a varnishing machine and including two auxiliary side members for supporting the varnishing cylinder or pressure cylinder, two motor spindles for pivoting the two side members, respectively, two support flanges for supporting the varnish feed roller, two other motor spindles for pivoting the support flanges, respectively, two support flanges for supporting the varnish feed roller, two other motor spindles for pivoting the support flanges, respectively, pressure sensors for sensing the axial pressures applied by the motor spindles, and respective pressure regulators controlling the applied pressures and thereby the pressure between the varnishing and pressure cylinders, and the varnishing cylinder and the varnish feed roller.

5 Claims, 2 Drawing Sheets

DEVICE FOR ADJUSTING PRESSURE APPLIED TO A VARNISHING CYLINDER OF A VARNISHING MACHINE

BACKGROUND OF THE INVENTION

The present invention relates to a device for adjusting pressure applied to a varnishing cylinder of a machine for varnishing in which workpieces are movable between a varnishing cylinder, having a shell formed of a rubber or any other elastic material, and a hard pressure cylinder, with the adjusting device including a first adjusting unit for adjusting the pressure between the varnishing and the pressure cylinders and a second adjusting unit for adjusting the pressure between the varnishing cylinder and a varnish feed roller of a varnishing unit.

Such varnishing machines are used, e.g., in manufacturing of drink cans, glass caps, or crown caps, where the workpieces, before being pressed, are covered with inner and outer varnish layer and, after pressing operation, with a protective varnish layer. The applied varnish should meet specific requirement so that it would not crack when the workpieces are subsequently subjected to stamping and deep-drawing.

In the old varnishing machine, varnish was just poured over a workpiece. The modern varnishing machines are designed with an object of insuring as economical use of varnish as possible. Therefore, often, the varnishing cylinders, which are adjusted for varnishing of surfaces in which blank areas need be provided, are fitted with exactly positioned cutouts or grooves. The advantage of the varnishing cylinders designed for varnishing of the entire surface of a workpiece consists in that they can be regrinded several times and, therefore, have an extended service life. However, due to the decrease of the diameter of the varnishing cylinder, which results from regrinding, the rotational speed of the varnishing cylinder need be adjusted. The adjustment of the rotational speed of the varnishing cylinder, to a lesser extent, is needed because of the soaking of the varnishing cylinder shell. Further, an exact adjustment of the pressure between the varnishing and pressure cylinders is necessary for obtaining of an extremely thin and, at the time, of a highly uniform varnish coating.

A varnishing machine with an adjusting device for adjusting the pressure between the varnishing and pressure cylinders and between the varnishing cylinder and the varnish feed roller is known. In this varnishing machine, the driving of the varnishing cylinder is effected by a pressure air-actuated slip clutch which enables a very fine control of the rotational speed of the varnishing cylinder during the operation of the varnishing machine. However, the control of the rotational speed requires participation of the operator. For effecting varnishing of surfaces with blank area, an electrical controller is used which monitors the adjustment of the varnishing cylinder. After the disconnection for adjusting purposes, a change lever is used for adjusting three operational conditions. Altogether, the following adjustment are important for a proper operation of the varnishing machine, namely, the adjustment of the varnishing cylinder and the varnish feed roller, the adjustment of all of the rollers, providing for their positioning parallel to each other, metering of the necessary amount of varnish. To this end, manually operating spindles are used. After effecting the necessary adjustments necessary for a particular operational condition, the varnishing cylinder and the varnish feed roller are fixed to the machine frame without any play. However, with these adjustments, a non-uniform contact pressure along the generatrix of the varnishing cylinder shell may occur, which, leads eventually to operating errors, and a desired reliability of the operation cannot be achieved.

Accordingly, an object of the invention is a pressure adjusting device for a varnishing machine of the above-described type which would insure obtaining of an extremely thin and highly uniform varnish coating.

Another object of the invention is a varnishing machine in which the adjustment of pressure between the varnishing and pressure cylinders and the varnishing cylinder and the varnish feed roller is effected automatically.

SUMMARY OF THE INVENTION

These and other objects of the present invention, which will become apparent hereinafter, are achieved by providing in a varnishing machine, two auxiliary side members pivotally attached to the frame for supporting the opposite supports of one of the varnishing cylinder and the pressure cylinder, two first tilting motor spindles for pivoting the two auxiliary side members and having respective one ends thereof attached to the frame and respective another ends thereof attached to the two auxiliary side members, respectively, two support flanges pivotally attached to the frame for supporting a varnishing unit, together with the varnish feed roller, two second tilting motor spindles for pivoting the support flanges, respectively, and having one ends thereof attached to the machine frame or respective side members and having the other ends thereof attached to the respective support flanges, pressure sensors for sensing axial pressure applied by each of the four motor spindles to a respective auxiliary side member or a support flange, and pressure regulators connected with the pressure sensors for controlling the axial pressure and thereby pressure between the varnishing and pressure cylinders and between the varnishing cylinder and the varnish feed roller to predetermined constant values.

With the varnishing machine according to the present invention, the manual operations are substantially reduced. The necessary adjustments are effected completely automatically with a high speed. Any deviations of actual values from the set ones are immediately compensated. While the motor spindles, which are provided on both sides of the machine, operate independently from each other, nevertheless a uniform contact pressure between the varnishing and the pressure cylinders is insured. The motor spindles insure a very fine pressure adjustment and exclude all post-oscillation which usually takes place when a hydraulic or pneumatic drive is used. In addition to a better quality and a greater reliability, the operational costs, associated with manual operations, are reduced, together with the reduction in floor space occupied by the machine resulting from the elimination of hand wheels for operating manually operable spindles. Additional advantage results from determining a stochastic actual diameter of the varnishing cylinder from an angular position of the varnishing cylinder, or the pressure cylinder, or the varnish feed roller and using this variable for controlling the rotational speed of the varnishing cylinder to conform it to that of the pressure cylinder.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
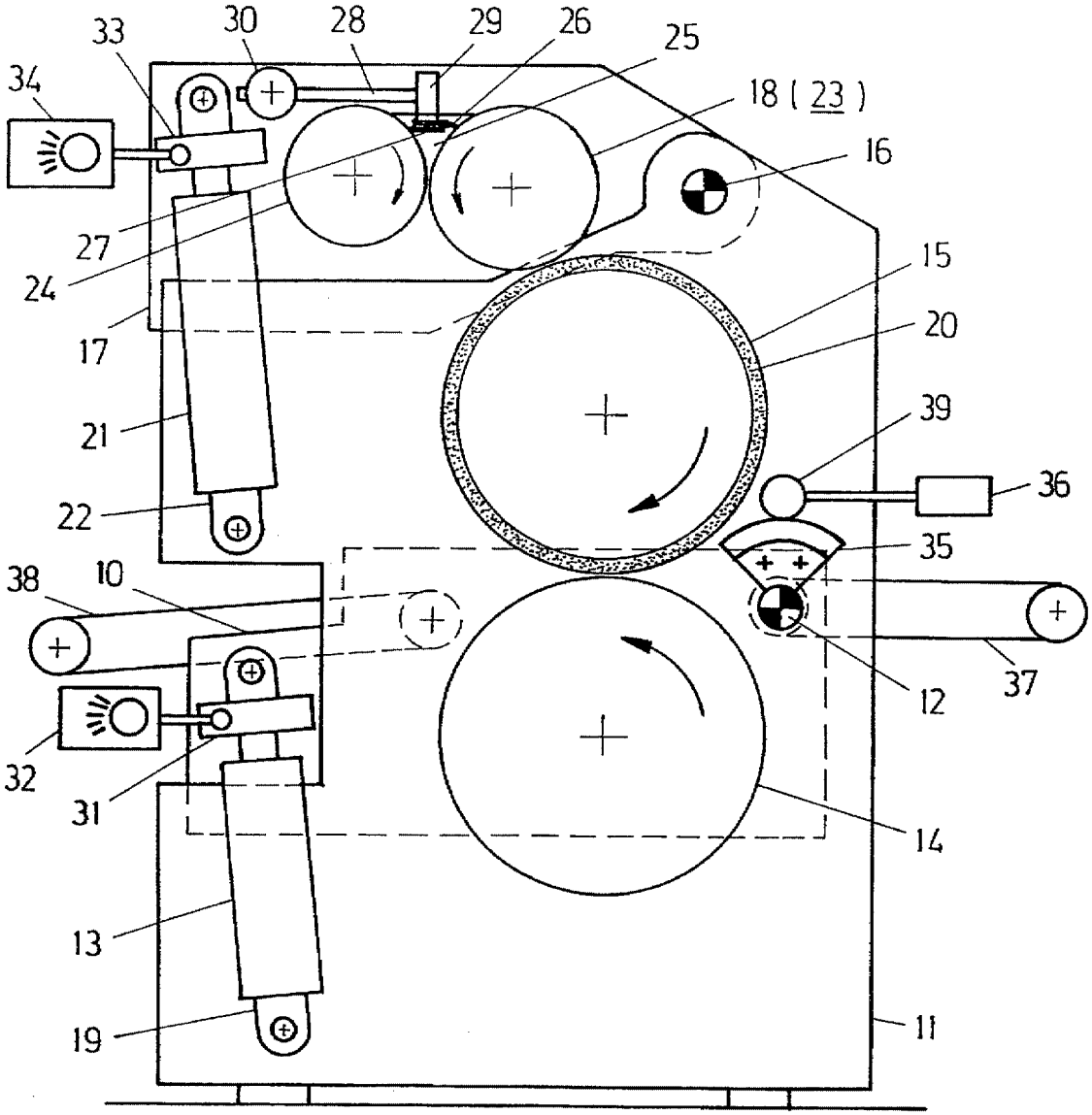
FIG. 1 shows a side view of a varnishing machine according to the present invention having a pivotable pressure cylinder.
Figure 2:
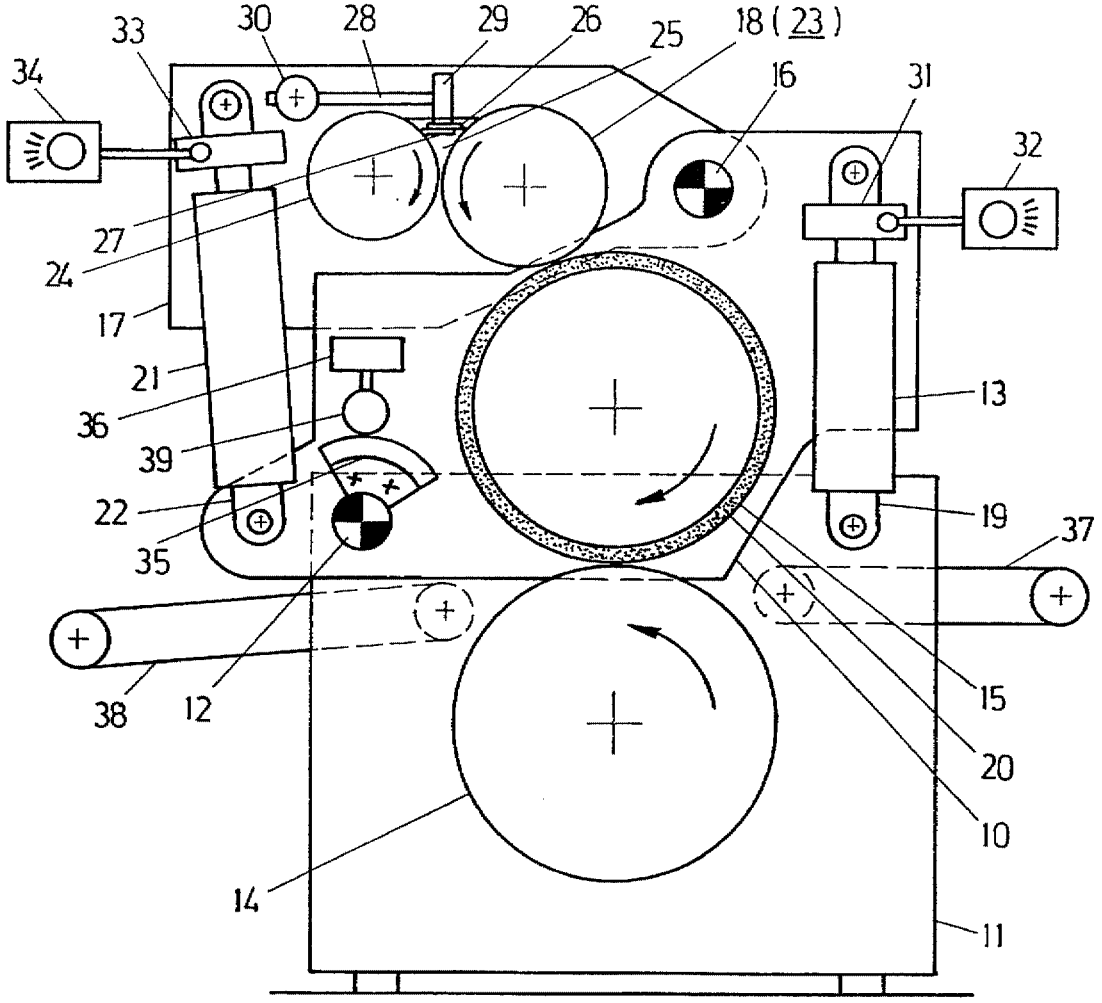
FIG. 2 shows a side view of a varnishing machine according to the present invention having

FIGS. 1 and 2 show two embodiments of a varnishing machine according to the present invention. The two embodiments of the inventive varnishing machine distinguish from each other, among others, by the shape of pairs of available auxiliary side members 10 and in the position relative thereto of a pivotal support 12 supported on a machine frame 11. In the inventive varnishing machine, a pressure cylinder 14 or a varnishing cylinder 15, together with its end side support, is arranged between a motor spindle 13, which is supported on the side member 10, and the pivotal support 12. A pivotal support 16 of each of both end side support flanges 17 of a varnish feed roller 18 is arranged either on the stationary machine frame 11 or on the pivotal auxiliary side member 10. The both motor spindles 13 are components of a positioning device 19 for applying pressure between a rubber shell 20 of the varnishing cylinder 15 and the hard pressure cylinder 14, and both motor spindles 21 are components of a positioning device 22 for applying pressure between the varnishing cylinder 15 and the varnish feed roller 18 of the varnish unit 23.

Advantageously, the entire varnish unit 23 is supported on both pivotal support flanges 17 which, in addition, provide for mounting of a device for adjusting pressure applied to the varnishing cylinder 15 of the varnishing machine, and facilitate maintenance of the varnishing machine. A particularly compact and reliable varnish delivery mechanism is obtained by using the varnish feed roller 18 and a varnishing roller 24 for limiting a varnish basin 25. The varnish feed roller 18 and the varnishing roller 24 preferably rotate in opposite directions in the region of the varnish basin 25 with a step-down speed. A scrapper blade 26 engaging the varnish feed roller 18 and a scrapper blade 27 engaging the varnishing roller 24 are located in the varnish basin 25 one above the other. Both scraper blades 26 and 27 are supported in a common holding device including a support beam 29 having pivot arms 28 for pivoting both scraper blades 26 and 27 upward from the varnish feed roller 18 and the varnishing roller 24 and then back downward. The pivot arms 28 are longitudinally displaceable on a shaft 30 the axis of which extend parallel to the axes of the rollers 18 and 24.

For a more convenient cleaning of the varnishing machine and in order to facilitate maintenance work, both pivotal support flanges 17 and both motor spindles 21, one ends of which are attached to the machine frame 11 or the auxiliary side member 10 and the other ends of which are pivotally attached to the support flange 17, are so mounted that in addition to insuring the application of pressure between the varnishing cylinder 15 and the varnish feed roller 18, they insure access to the varnishing cylinder 15. To this end, the motor spindles have an increased adjusting stroke, the support flanges 17 have an elongated form, and the pivotal supports 16 are spaced from the common contact point of the varnishing cylinder 15 and the varnish feed roller 18 by an increased distance.

The pressure applied to each motor spindle 13 is sensed by a respective pressure sensor 31 and is adjusted to a predetermined constant value by a respective pressure regulator 32 which is connected with the respective sensor 31. Thereby, a completely automatic pressure adjustment between the varnishing cylinder 15 and the pressure cylinder 14 takes place, which also takes into consideration the soaking of the shell 20 of the varnishing cylinder 15 and the regrinding of the varnishing cylinder 15.

The pressure adjustment between the varnishing cylinder 15 and the varnish feed roller 18 is effected in the same manner, with the pressure applied to the motor spindles 21 being sensed by respective pressure sensors 33 and controlled by respective pressure regulators 24, connected with the pressure sensors, 33, to a predetermined constant value.

The angular position of the varnishing cylinder 15, or the pressure cylinder 14, or the varnish feed roller 18 is sensed by a displacement sensor 35 which transmits a position signal to an angular speed controller 36. In the angular speed controller 36, the position signal generated by the sensor 35 is used for controlling the circumferential or angular speed of the varnishing cylinder 15 so that it conforms to that of the pressure cylinder 14. Even at a very large diameter area of the varnishing cylinder, which, apart from swelling of the shell 20, requires often regrinding, the adaptation of the angular speed can be very precise and, at the same time, inexpensive. By adapting the rotational or angular speed of the varnishing cylinder 15, the unused varnish fields of the varnishing cylinder 15 are held stationary on the shell 20 of the varnishing cylinder 15, whereby the bottom sides of the following one another workpieces are kept clean. At that, the belts 38 which are provided, in addition to the inlet belts 37, for removal of the varnished workpieces, are driven synchronously with the rotation of the pressure cylinder 14.

A preferred embodiment of the displacement sensor 35 includes a variable resistance of a potentiometer 39 which rotates in response to the pivotal movement of the auxiliary side member 10. This permits to reduce to a minimum the additional expenditure associated with providing means for controlling the rotational speed of the varnishing cylinder 15. The precision of the adaptation of the rotational speed of the varnishing cylinder 15 is further increased by the fact that the pressure sensor 31, which is associated with the auxiliary side member 10, is connected to the pressure regulator 32 at the middle of the workpiece.

The inlet and outlet belts 37 and 39 are adapted for one-side varnishing of plate-shaped thin metal sheets. However, the varnishing machine can be also used for varnishing of a plate-shaped paper material and cardboard.

Also of importance is a possibility of forming in the varnishing layer areas, which are free of varnish, especially when precise uncovered areas need be provided on foldable blanks of collapsible folding boxes.

Though the present invention was shown and described with reference to the preferred embodiments, various modifications thereof will be apparent to those skilled in the are and, therefore, it is not intended that the invention be limited to the disclosed embodiments or details thereof, and departure can be made therefrom within the spirit and scope of the appended claims.

What is claimed is:

1. A device for adjusting pressure applied to a varnishing cylinder of a varnishing machine including a frame, a varnishing cylinder having two opposite supports, a pressure cylinder for applying pressure to a workpiece movable between the varnishing and pressure cylinders and likewise having two opposite supports, and a varnish feed roller, the pressure adjusting device comprising:

two auxiliary side members pivotally attachable to the frame for supporting the opposite supports of one of the varnishing cylinder and the pressure cylinder;

first means for adjusting pressure between the varnishing and pressure cylinders, the pressure adjusting means including two first tilting motor spindles for pivoting the two auxiliary side members and having respective one ends thereof attachable to the frame and respective another ends thereof attachable to the two auxiliary side members, respectively;

two spaced support flanges for supporting the varnish feed roller;

second means for adjusting pressure between the varnishing cylinder and the varnish feed roller, the second pressure adjusting means including two second tilting motor spindles for pivoting the two support flanges, respectively, and having respective one ends thereof attachable to one of the frame and an auxiliary side member, and respective another ends thereof attachable to respective support flanges;

pressure sensor means supported on the auxiliary side members for sensing axial pressure applied by each of the first and second motor spindles to respective auxiliary side members and support flanges; and pressure regulator means connected with the pressure sensor means for controlling the axial pressure applied by a respective motor spindle to a predetermined constant value.

2. A varnishing machine, comprising:

a frame;

a varnishing cylinder having two opposite supports;

a pressure cylinder for applying pressure to a workpiece movable between the varnishing and pressure cylinder and likewise having two opposite supports;

a varnish feed roller; and a device for adjusting pressure applied to the varnishing cylinder, the pressure adjusting device comprising:

two auxiliary side members pivotally attached to the frame for supporting the opposite supports of one of the varnishing cylinder and the pressure cylinder;

first means for adjusting pressure between the varnishing and first pressure cylinder, the pressure adjusting means including two first tilting motor spindles for pivoting the two auxiliary side members and having respective one ends thereof attached to the frame and respective another ends thereof attached to the two auxiliary side members, respectively;

two spaced support flanges for supporting the varnish feed roller;

second means for adjusting pressure between the varnishing cylinder and the varnish feed roller, the second pressure adjusting means including two second tilting motor spindles for pivoting the two support flanges, respectively, and having respective one ends thereof attached to one of the frame and an auxiliary side member, and respective another ends thereof attached to respective support flanges;

pressure sensor means supported on the auxiliary side members for sensing axial pressure applied by each of the first and second motor spindles to respective auxiliary side members and support flanges; and pressure regulator means connected with the pressure sensor means for controlling the axial pressure applied by a respective motor spindle to a predetermined constant value.

3. A varnishing machine as set forth in claim 2, wherein the varnish feed roller is a component of a varnishing unit, the entire varnishing unit being supported by the two support flanges.

4. A varnishing machine as set forth in claim 2, further comprising displacement sensor means for sensing an angular position of one of the varnishing cylinder, the pressure cylinder, and the varnish feed roller and for generating an angular position signal to be used as a control variable of control means for adjusting a rotational speed of the varnishing cylinder.

5. A varnishing machine as set forth in claim 4, wherein the displacement sensor means comprises a variable resistance of a potentiometer rotatable in accordance with a pivotal movement of a respective auxiliary side member.

* * * * *

UNITED STATES PATENT AND TRADEMARK OFFICE

CERTIFICATE OF CORRECTION

PATENT NO. : 5,667,591

DATED : September 16, 1997

INVENTOR(S) : Udo Mailänder

It is certified that error appears in the above-identified patent and that said Letters Patent is hereby corrected as shown below:

Title page, item [73] should read as follows:

[73] Assignee: LTG Lufttechnische GmbH, Stuttgart, Germany

Signed and Sealed this

Seventeenth Day of February, 1998

*Attest:*

Bruce Lehman

BRUCE LEHMAN

*Attesting Officer*

*Commissioner of Patents and Trademarks*